US011083927B2

(12) United States Patent
Pedersen

(10) Patent No.: US 11,083,927 B2
(45) Date of Patent: Aug. 10, 2021

(54) MUSCULAR TRAINING TENSION BAND FOR EQUESTRIAN RIDING

(71) Applicant: Britta A. Pedersen, Encinitas, CA (US)

(72) Inventor: Britta A. Pedersen, Encinitas, CA (US)

( * ) Notice: Subject to any disclaimer, the term of this patent is extended or adjusted under 35 U.S.C. 154(b) by 0 days.

(21) Appl. No.: 16/860,059

(22) Filed: Apr. 27, 2020

(65) Prior Publication Data

US 2020/0338390 A1 Oct. 29, 2020

Related U.S. Application Data

(60) Provisional application No. 62/839,418, filed on Apr. 26, 2019.

(51) Int. Cl.
*A63B 21/00* (2006.01)
*A63B 21/055* (2006.01)

(52) U.S. Cl.
CPC .... *A63B 21/4025* (2015.10); *A63B 21/00185* (2013.01); *A63B 21/0555* (2013.01); *A63B 21/4005* (2015.10); *A63B 21/4015* (2015.10); *A63B 2244/24* (2013.01)

(58) Field of Classification Search
CPC ... A63B 21/00185; A63B 21/02; A63B 21/04; A63B 21/0407; A63B 21/0428; A63B 21/0442; A63B 21/055–0557; A63B 21/4005; A63B 21/4015; A63B 21/4025; A63B 2244/24
See application file for complete search history.

(56) References Cited

U.S. PATENT DOCUMENTS 1,663,641 A * 3/1928 Smallwood ..... A63B 21/0004 482/124
1,998,226 A * 4/1935 Draheim ..... A63B 21/4003 482/124
4,090,706 A * 5/1978 Reda ..... A63B 21/0004 482/122
4,327,909 A * 5/1982 Neufeld ..... A61F 5/3738 482/124
4,540,173 A * 9/1985 Hopkins, Jr. ..... A63B 21/0552 482/124
4,789,154 A * 12/1988 Mattox ..... A63B 21/0552 482/10
5,716,307 A * 2/1998 Vadher ..... A43B 7/20 482/124
2008/0009398 A1* 1/2008 Grisdale ..... A63B 21/0552 482/124
2016/0256728 A1* 9/2016 Tang ..... A63B 23/03516

* cited by examiner

*Primary Examiner* — Jennifer Robertson
(74) *Attorney, Agent, or Firm* — Paul C. Oestreich; Eminent IP, P.C.

(57) ABSTRACT

A muscular training tension band for equestrian riding has an elastic body and a shoulder guard. In use, the elastic body is worn and stretched between a wearer's shoulder and contralateral foot, with the shoulder guard positioned on the shoulder. The tension band functions to recruit correct engagement of a horseback rider's postural stabilizing muscles in order to find a functionally effective and balanced pelvis in the saddle, while also protecting the spine and decreasing the risk of repetitive force related injuries.

16 Claims, 5 Drawing Sheets

MUSCULAR TRAINING TENSION BAND FOR EQUESTRIAN RIDING

The current application claims a priority to the U.S. Provisional Patent application Ser. No. 62/839,418 filed on Apr. 26, 2019. The current application is filed on Apr. 27, 2020, whereas Apr. 26, 2020 was on a weekend.

FIELD OF THE INVENTION

The present invention relates generally to equestrianism. More particularly, the present invention relates to a tensioned support apparatus for use in equestrianism.

BACKGROUND OF THE INVENTION

Horseback riding and similar equestrian related recreational activities necessitate a particular degree of skill, caution, and balance that is not easily put into practice as a beginner. Typically, an experienced mentor is needed as well as carefully constructed and monitored circumstances that would otherwise leave the rider to peril. This is consequent to the precarious nature of horse riding where, without trained balance, a rider may fall off their mount and either sustain injury from the fall or by being trampled by an out of control horse. It is therefore the objective of the present invention to introduce a recreational ride-training support tool that particularly tensions a strap or multiples thereof about a user's body between their shoulder and their opposing foot, forming a sling, wherein the tensioning therebetween balances and stabilizes the forces imparted about the user's lumbo-pelvic complex to assist in maintaining stability while riding. The sling transfers a load force incurred by muscle movements of the user through the straps about the lumbo-pelvic region. The user is enabled to impart superficial muscle movements into the individual strap that allow complex muscle movement without detracting from the user's balance. The sling utilizes an elastic body about the user and works to recruit the correct engagement of core postural stabilizers including the calves, hamstrings, gluteals, contralateral transverse abdominus, oblique, middle trapezius, lower trapezius, serratus anterior and rhomboid muscles. This correctly engaged muscular firing pattern aids as a training tool to establish a functionally effective and balanced pelvis in the saddle while protecting the spine and decreasing the risk of repetitive force related injuries. The present invention further accommodates at least one shoulder guard optionally thereon to cushion pressure imparted by the elastic body, consequent to the tension incurred about the user's body. Thus, the present invention provides a support system that is particularly effective in various horseback riding uses that requires balance between superficial and core muscle groups and adjacent bodies or constituents thereof through a plurality of straps with an elastic body thereof that are wrapped around a user. The tension and pressure thereof imparted by the elastic body is cushioned by the shoulder guard.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a tension band accessory used for muscular training, particularly in an equestrian setting. The present invention is principally described herein as a single band unit; however, it may be understood that in practical usage, it may be preferable for multiple units of the present invention to be utilized simultaneously.

Figure 1:
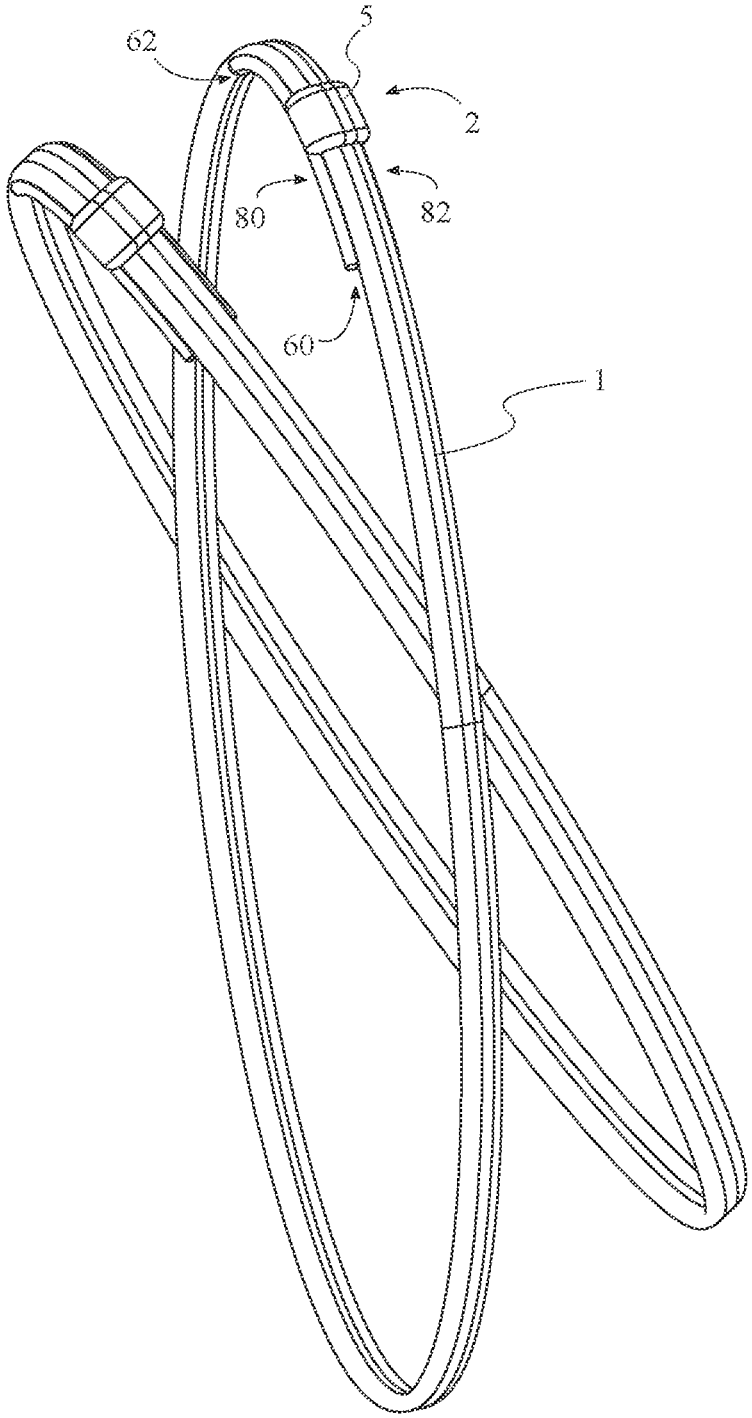
FIG. 1 is a front perspective view showing a pair of the present invention.
Figure 2:
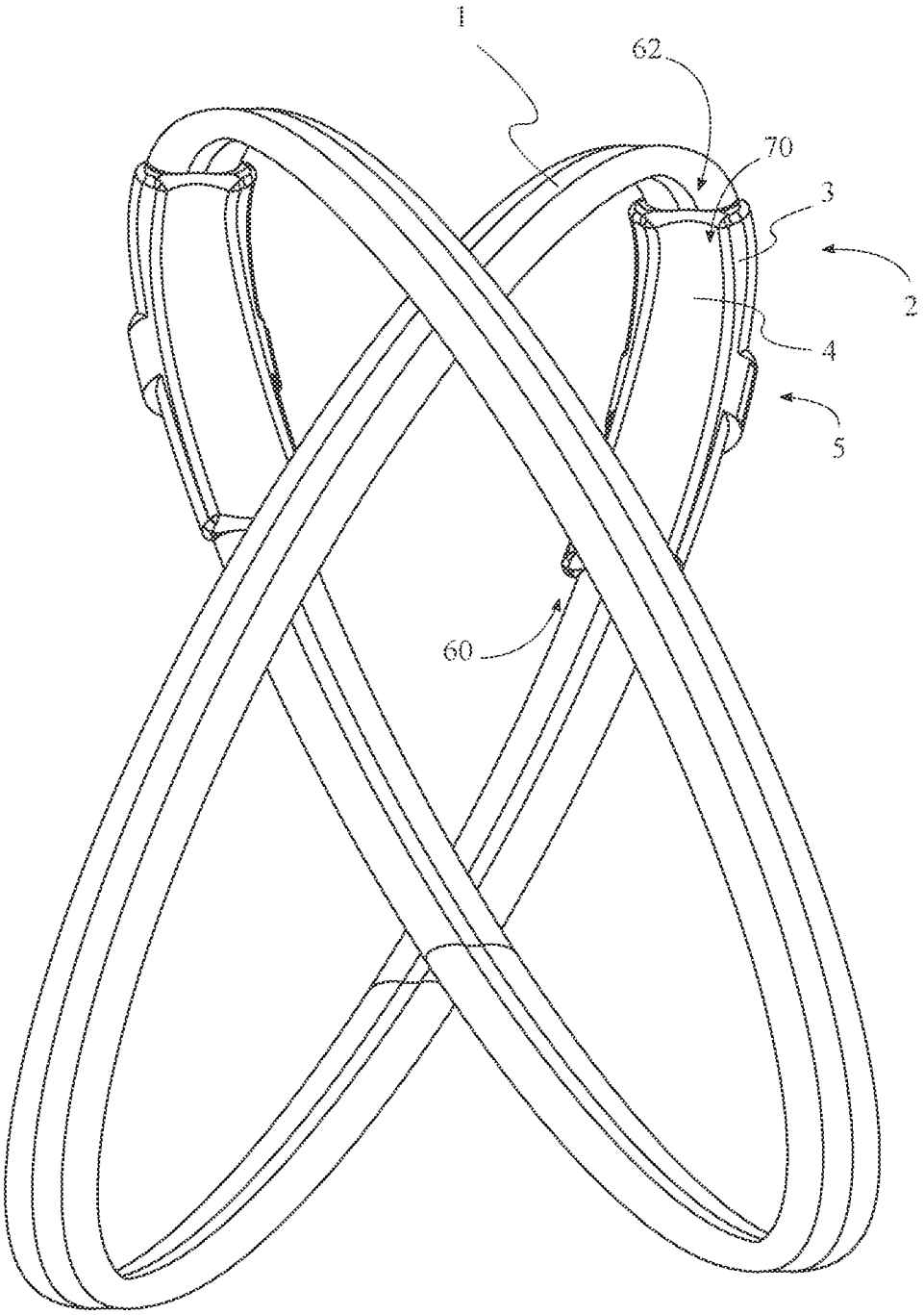
FIG. 2 is a rear perspective view showing a pair of the present invention.
Figure 3:
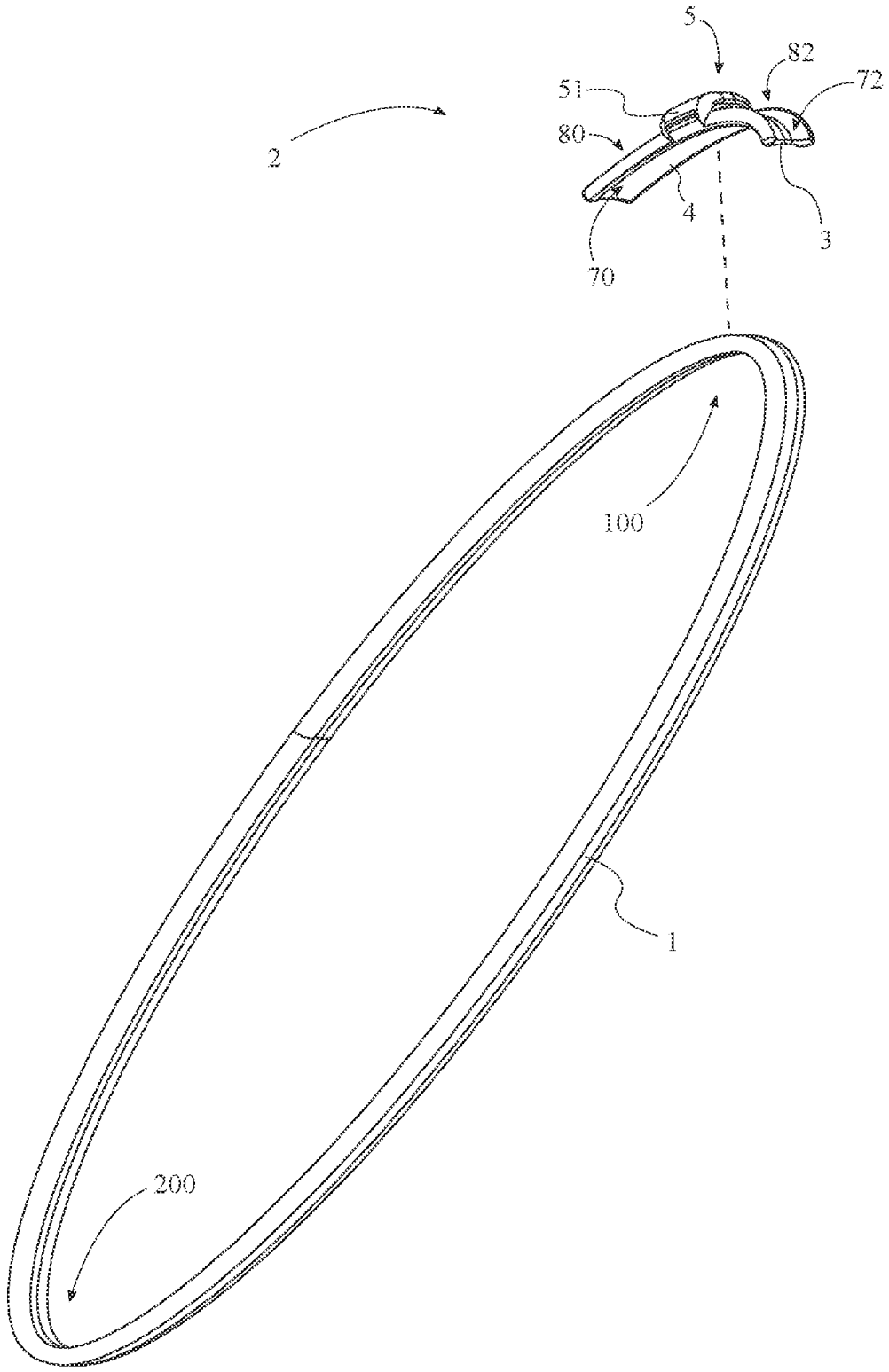
FIG. 3 is a perspective view showing an exploded view of the present invention.

Referring to FIGS. 1-3, the preferred embodiment of the present invention comprises an elastic body 1 and a shoulder guard 2. The shoulder guard 2 comprises a shoulder guard body 3, a padding 4, and a band fastener 5, wherein the shoulder guard body 3 extends between a first end 60 and a second end 62. The padding 4 is connected adjacent to the shoulder guard body 3 and traverses along an inner side 70 of the shoulder guard body 3 between the first end 60 and the second end 62 of the shoulder guard body 3.

The band fastener 5 is connected to the shoulder guard body 3 and positioned adjacent to an outer side 72 of the shoulder guard body 3, wherein the inner side 70 and the outer side 72 are positioned opposite each other on the shoulder guard body 3. Furthermore, the shoulder guard 2 is attached to the elastic body 1 through the band fastener 5.

In the preferred embodiment of the present invention, the elastic body 1 is constructed of a heavy duty elastomer such as, but not limited to, natural rubber, silicone rubber, or any other suitable elastically deformable material or combination of materials. Furthermore, in the preferred embodiment, the elastic body 1 is a continuous, closed loop of material, though this is not necessarily a requirement and alternative constructions, geometries or arrangements may be realized in various embodiments. More particularly, in the preferred embodiment, the elastic body 1 is a flat, elastically deformable band. It is desirable for the elastic body 1 to take a flattened band-like shape in order to provide adequate surface area at various points of contact of a user, thus facilitating stable contact between the user's body and the present invention, in addition to spreading out the compressive forces experienced at the points of contact to minimize discomfort. It should be noted, however, that the aforementioned flat band structure is not a strict requirement, and the elastic body 1 may take any form suitable to the spirit and purpose of the present invention.

The shoulder guard 2 is included in the present invention in order to further facilitate the aforementioned purpose of comfort, or minimization of discomfort, experienced by the user during use of the present invention. As previously mentioned, the shoulder guard 2 is attached to the elastic body 1 through the band fastener 5 of the shoulder guard 2. In some embodiments, the shoulder guard 2 may be permanently connected to the elastic body 1 through the band fastener 5, wherein the band fastener 5 may take any suitable form in such embodiments, such as, but not limited to, one or more mechanical fasteners or fastening means such as staples, rivets, screws, buckles, grommets, eyelets, clamps, pins, stitching, any suitable adhesive compound, or any other suitable fastening means.

In some embodiments, the shoulder guard 2 is removably attached to the elastic body 1 through the band fastener 5, and thus is configured to be readily removable from the elastic body 1 by the user by disengaging the band fastener 5. This allows for replacement of worn or failed components, or for customization of a particular embodiment of elastic body 1 or shoulder guard 2 in order to tailor to a particular user's preference or physical requirements. As with the previously discussed permanent connection in some embodiments, the specific nature of the removably attachment between the elastic body 1 and the shoulder guard 2 in some embodiments may vary as suitable and desirable to implement.

In particular, in some embodiments of the present invention, the band fastener 5 is a hinge clasp, which affords the user a quick and easy means through which to remove or replace the elastic body 1 or the shoulder guard 2. To this end, in some embodiments, the band fastener 5 may be understood to comprise a first fastener end 51 and a second fastener end 52, while the shoulder guard body 3 extends laterally between a first lateral side 80 and a second lateral side 82. The first fastener end 51 is hingedly connected to the first lateral side 80 of the shoulder guard body 3, while the second fastener end 52 is removably attached to the second lateral side 82 of the shoulder guard body 3. Thus, the elastic body 1 may be removably positioned between the band fastener 5 and the shoulder guard body 3 between the first lateral side 80 and the second lateral side 82.

Figure 5:
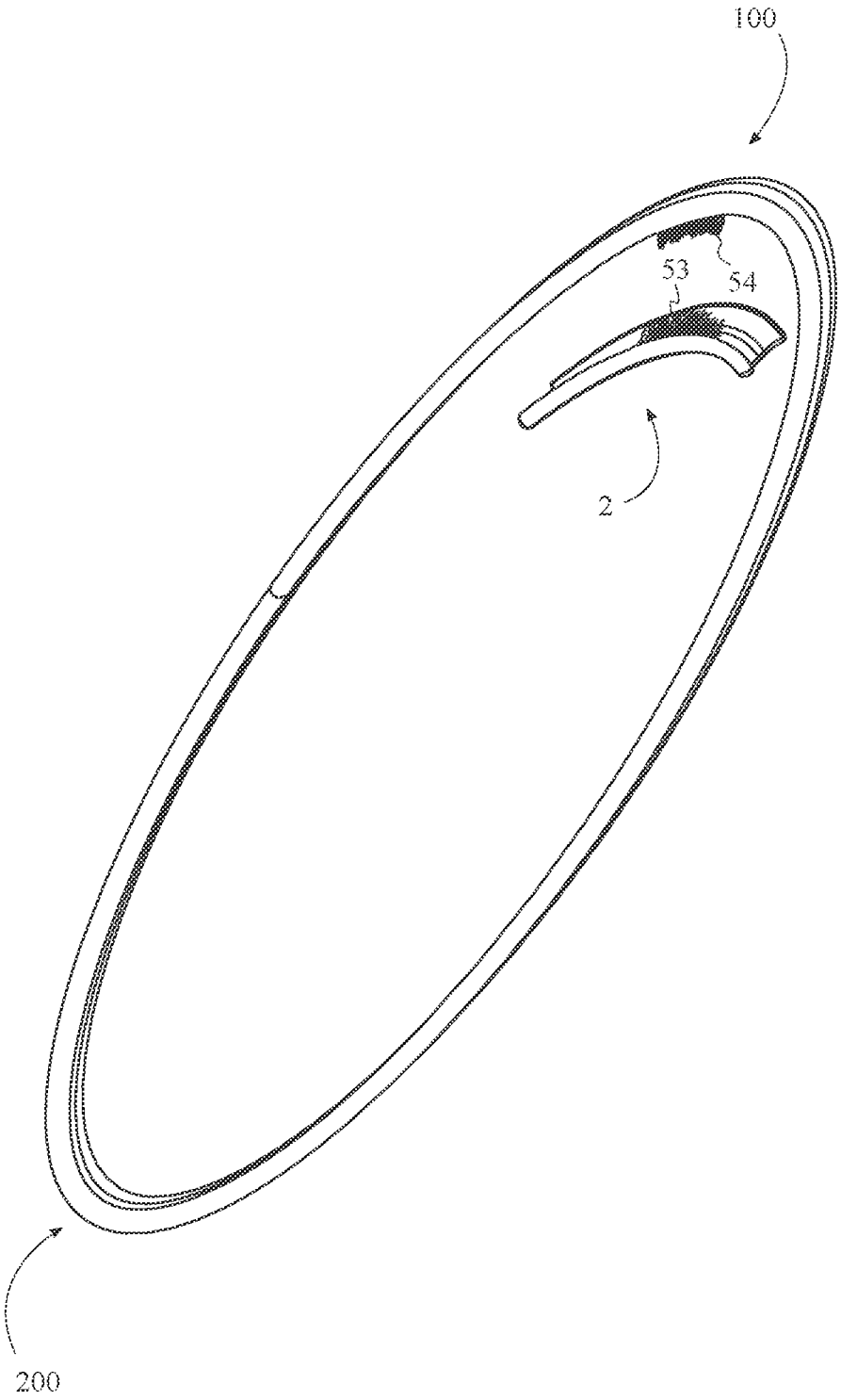
FIG. 5 is a perspective exploded view of the present invention using hook and loop tape as the band fastener.

Alternatively, as shown in FIG. 5, in some embodiments the band fastener 5 may comprise a first hook and loop tape portion 53, while a second hook and loop tape portion 54 is connected to the elastic body 1. Thus, the first hook and loop tape portion 53 and the second hook and loop tape portion 54 are removably attached to each other such that the elastic body 1 is removably attached to the shoulder guard 2 through the first hook and loop tape portion 53 and the second hook and loop tape portion 54. As previously noted, other fastening or attachment means may be utilized in other embodiments.

Figure 4:
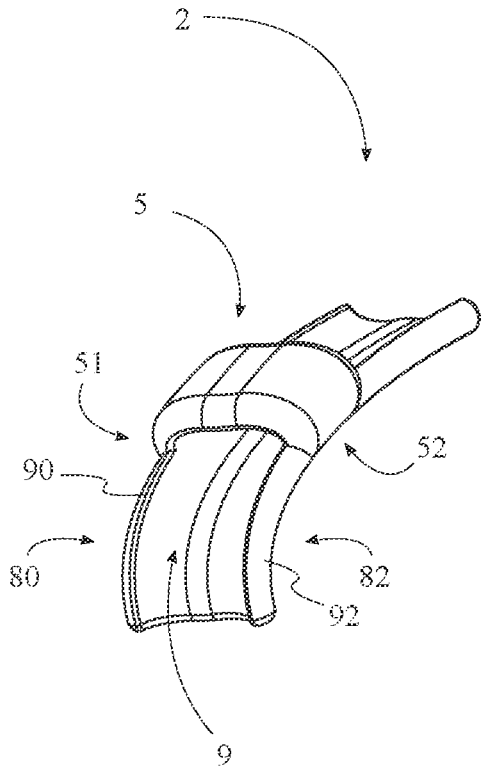
FIG. 4 is a perspective view of the shoulder guard of the present invention.

Furthermore in the preferred embodiment, the shoulder guard 2 further comprises a band channel 9, a first retaining lip 90, and a second retaining lip 92, as seen in FIG. 4. The first retaining lip 90 traverses along the first lateral side 80 of the shoulder guard body 3, while the second retaining lip 92 traverses along the second lateral side 82 of the shoulder guard body 3. The band channel 9 traverses along the outer side 72 of the shoulder guard body 3 between the first end 60 and the second end 62, and the band channel 9 is laterally delineated by the first retaining lip 90 and the second retaining lip 92, such that the elastic body 1 is retained within the band channel 9 adjacent to the outer side 72 of the shoulder guard body 3 by the first lateral side 80 and the second lateral side 82.

As previously noted, the elastic body 1 of the present invention is configured to be tensioned between a human shoulder and a human foot of a user. The user places their foot against the interior of the elastic body 1 opposite the shoulder guard 2, and places the shoulder guard 2 against their shoulder contralateral to their foot, not necessarily in that order. As the present invention is intended to be used in pairs, as illustrated in FIG. 1, the user repeats the aforementioned process with another instance of the present invention for their remaining shoulder and foot.

More particularly, the shoulder guard 2 may be regarded to be attached to the elastic body 1 at a shoulder mounting point 100, wherein a foot mounting point 200 is positioned opposite the shoulder mounting point 100 along the elastic body 1. The shoulder guard 2 is configured to conform to a human shoulder in the preferred embodiment. This may be accomplished in any suitable manner, but preferably, the shoulder guard body 3 is shaped, formed, or molded through any suitable means to conform to the shape of a human shoulder. The foot mounting point 200 may also be configured to receive a human foot in some embodiments, or more particularly in some embodiments the bottom of a shoe, boot, or other footwear worn by the user. Generally, it may be understood that no additional components may be necessary to implement the foot mounting point 200, and the foot mounting point 200 may be understood to simply represent an imaginary point on the elastic body 1 opposite the shoulder guard 2 at which the user places their foot in order to apply tension to the elastic body 1. However, in some alternative embodiments, a foot support may additionally be comprised by the present invention, either removably attached or permanently connected to the foot mounting point 200 through any suitable means. The foot support may be realized in as simple a form as a flat plate of wood, metal or other stiff material, or the foot support may comprise various features and geometry that may allow the foot support to enhance the ease of use of the present invention. For example, in some embodiments, the foot support may comprise a base and at least one foot strap, wherein the foot strap is configured to retain the user's foot against the foot support. In some embodiments, the foot support may be comprise a receiving cavity, wherein the receiving cavity may be generally shaped similar to the bottom shape of a shoe, or to more particularly accommodate the shape of a bare foot, and/or the foot support may comprise other relevant features and/or configurations.

In an alternative embodiment of the present invention, the present invention as hitherto described may be duplicated and mirrored laterally, such that the present invention may comprise a first training band instance and a second training band instance, comprising, respectively, a first elastic body 1 and a first shoulder guard 2, and a second elastic body 1 and a second shoulder guard 2, each configured as previously disclosed. The first elastic body 1 and the second elastic body 1 may be connected to each other at an intermediate connection point between the shoulder mounting point 100*s* and the foot mounting points 200 of the first training band instance and the second training band instance, or at another desirable point. The intermediate connection point should be coincident with a sagittal plane of the user's body, such that the first training band instance and the second training band instance are generally mirrored about the sagittal plane.

The following is an alternative, exemplary description intended to further illustrate the spirit of the present invention, and is not intended to be limiting.

In some instances, the present invention may be referred to as a "rider performance torso sling." The present invention is designed as a horseback rider training tool to address stability of the lumbo-pelvic complex and the anatomical/myofascial sling systems (both local and global) which govern it. For equestrian athletes, it is critical to understand how the body's slings connect and function, so that their position in the saddle may be aligned for optimal performance. The anatomical/myofascial sling system of the present invention serves an eminently practical purpose: to aid in movement and function on a horse with greater coordination, grace and athleticism, whilst protecting the rider's pelvis & spine.

The lumbo-pelvic complex plays a key role in both distributing load and maintaining stability during movement and changes to a rider via external demands from a horse. Its primary function is to safely allow the transfer of forces and to allow complex movements whilst remaining in a state of balance, without causing injury.

A rider's superficial muscle activity should occur in synergy with the deeper muscular system. This is an integral part of dynamic movement in the equestrian athlete. The anatomical slings of the body, otherwise known as 'myofascial slings,' relate very closely to superficial muscle activity. The myofascial slings are comprised of muscles, fascia and ligaments all working together to create stability and mobility.

During riding, a muscle contraction will produce a force that spreads beyond the origin and insertion of the active muscle. These specific forces are transmitted through structures within a Myofascial sling, allowing forces to be produced quite distant from the origin of the initial muscle contraction; referred to as a force vector. The muscles within a myofascial sling are connected via fascia to produce force vectors which assist in the transfer of load within the lumbo-pelvic region. The muscles within a myofascial sling may overlap and interconnect with other slings depending on the change in force vectors needed for a competent dynamic movement. When the force vectors are balanced, they provide optimal alignment of the bones and joints throughout the dynamic movement, maintaining our saddle position in optimal balance. In contrast, imbalanced force vectors resulting from altered tension in the myofascial slings, can create malalignment and potentially contribute to a loss of stability during the dynamic task of riding.

There are two main myofascial anatomical slings involved for the performance of the Equestrian Athlete:

1. The POS (Posterior Oblique Sling), otherwise known as the back functional line. It crosses approximately at the level of the sacro-lumbar junction. The two slings of the POS form a large X across the back, from each shoulder to the opposite hip and have a primary function of pelvic stability in the saddle.

2. The PLS (Posterior Longitudinal Sling) connects the erector spinae, multifidus, thoracolumbar facia, sacrotuberous ligament and the biceps femoris. This sling allows for movement in the sagittal plane whilst simultaneously influencing local stability of the pelvis. It has a primary function of aiding a dressage rider in elongation of the leg whilst keeping a stable deep seat and an elevated torso. Thinking of a balanced sitting trot is recommended.

The Equiformance Torso Sling of the present invention is a continuous band of specific width and length with runs from the rider's contralateral shoulder to heel. It works to recruit the correct engagement of a rider's core postural stabilizers including the calves, hamstrings & gluteals with their contralateral transverse abdominus, oblique, mid & lower trapezius, serratus anterior and rhomboid. This correctly engaged muscular firing pattern of a rider's sling systems aids as a training tool to find both a functionally effective and balanced pelvis in the saddle, whilst protecting the spine and decreasing the risk of repetitive force related injuries.

The present invention comprises a plurality of straps and at least one shoulder guard. The plurality of straps further comprises an elastic body, a first strap, and a second strap. The elastic body further comprises a first surface and a second surface. The at least one shoulder guard further comprises a shoulder recess, a shoulder clasp band, a shoulder clasp fastener, and a shoulder padding.

The plurality of straps preferably comprises a count of two that are tangentially adjacent to one another between two points thereof in the exemplified embodiment. Where the plurality of straps comprises individually a banded elastic body that wraps around the extraneous user between the shoulder and the foot on the opposing side thereof. The plurality of straps preferably is used to address the stability of the lumbo-pelvic complex in the preferred embodiment and comprise a tension appropriately thereof. In the exemplified embodiment, the plurality of straps may comprise a count of two, however as few as one strap may be employed by the extraneous user.

Each individual strap of the plurality of straps comprises an elastic body that further preferably comprises elastic, rubber, composite, or similar materials that facilitate tension between the shoulder of the user and the foot on the opposing side of the user. Wherein the elastic body preferably comprises a first surface and a second surface in the exemplified embodiment.

Disposed on the interior facing surface of the elastic body of the plurality of straps is the first surface. Wherein the first surface preferably engaged the at least one shoulder guard optionally. Where the first surface further is engaged with the user's body, preferably about the calves, hamstrings, gluteals, contralateral transverse abdominus, oblique, middle trapezius, lower trapezius, serratus anterior and rhomboid and muscle groups thereabout. The first surface is further notched into the recess of the user's extraneous boot, thereby mitigating dislodging therefrom amid a tensioned engagement with the user.

Opposite the first surface and engaged with the shoulder clasp band is the second surface. Wherein the second surface is disposed on the exterior facing surface of the elastic body of the plurality of straps. Wherein the second surface preferably is homogenous in material and equivalent or near thereof in sheer force with the first surface. The second surface is further predominantly oriented away from the user's body in the preferable embodiment.

Near identical to the second strap and tangentially adjacent therewith is the first strap. Wherein the first strap preferably stretches across the shoulder of the extraneous user, banding around to the foot of the opposing side. Wherein the first strap further mirrors the second strap about the extraneous user's body. The first strap further may be linked within the hole of the second strap perimetrically defined by the first surface. Wherein the first strap may optionally comprise a mechanism to associate ends of the first strap together or disengage therewith. Where further optionally, the mechanism thereof may include, but is not limited to: a knot, a locking means, hooks and grommets, self-locating geometry, snap fitting, and so on.

Similarly, near identical and tangentially adjacent with the first strap is the second strap. Wherein the second strap is mirrored with the first strap about the user's extraneous body. The second strap further preferably stretches between the extraneous shoulder of the user to the foot of the user opposite the side of the shoulder thereof. Wherein the shoulder portion of the second strap is opposite the location of the shoulder portion of the first strap. Where further the location of the feet follows a similar relationship of mirroring about the user's body respective of the first strap and the second strap. The second strap may be considered an optional second strap where the extraneous user is compensating a single deficiency localized to a single side of the respective user.

Preferably, at least one shoulder guard is located on the plurality of straps. Wherein the at least one shoulder guard may be disposed on the first strap, the second strap, or both. The at least one shoulder guard mitigates the pressure of the tension consequent to the elastic body of the plurality of straps to the extraneous user's shoulders. Wherein the at least one shoulder guard further preferably clasps to an individual strap of the plurality of straps or both. The at least one shoulder guard further disposes the shoulder clasp fastener on the exterior surface of the individual shoulder guard. Whereupon a shoulder clasp band with a complementing clasp fastener may engage to clamp the at least one shoulder guard about the elastic body of the plurality of straps. The at least one shoulder guard may be considered an optional shoulder guard if the extraneous user possesses sufficient layers of clothing.

Located on the surface of the individual shoulder guard opposite the shoulder padding and the first strap or the second strap is the shoulder recess. Wherein the shoulder recess preferably accommodates the respective strap therein and may lock the traversal thereof consequent to frictional surfaces between the respective shoulder guard and the respective individual strap. The shoulder recess further is adjacent with the shoulder clasp band on one distal end thereof, and may be mounted by a fastening mechanism including, but not limited to: stitching, adhesives, conventional fasteners and so on.

Disposed tangentially along the outer perimeter of the shoulder recess and the at least one shoulder guard's body is the shoulder clasp band. Wherein one distal end of the shoulder clasp band is preferably connected to the at least one shoulder guard and permitted to hinge freely thereabout. The shoulder clasp band further preferably comprises a complementing clasp fastener that engages with the shoulder clasp fastener. Where engagement therewith facilitates arresting the movement of the shoulder clasp band relative to the at least one shoulder guard and wrapping around the second surface of the individual strap of the plurality of straps. The shoulder clap band further preferably comprises a cloth, leather, or similar material that is free-flowing and readily malleable to facilitate ease of fastening. However, the shoulder clasp band may comprise alternate materials such as, but not limited to: metal, wood, plastic, and so on.

Located on the exterior surface of the at least one shoulder guard is the shoulder clasp fastener. Wherein the shoulder clasp fastener is preferably disposed on the lateral side of the individual shoulder guard opposite the shoulder clasp band and the distal end thereof mounted to the individual shoulder guard. Wherein the shoulder clasp fastener may engage with a complementing clasp fastener on the shoulder clasp band to clamp down upon the elastic body of the plurality of straps.

Disposed on the at least one shoulder guard on the surface opposite the shoulder recess is the shoulder padding. Where preferably the shoulder padding is oriented such that the surface thereof is in contact with the extraneous user's shoulder. Wherein the shoulder padding may mitigate the pressure consequent the tension imparted by the elastic body of the plurality of straps to the extraneous user's shoulder.

Although the invention has been explained in relation to its preferred embodiment, it is to be understood that many other possible modifications and variations can be made without departing from the spirit and scope of the invention as hereinafter claimed.

What is claimed is:

1. A muscular training tension band for equestrian riding comprising:

an elastic body;

a shoulder guard;

the shoulder guard comprising a shoulder guard body, a padding, and a band fastener, wherein the shoulder guard body extends between a first end and a second end;

the padding being connected adjacent to the shoulder guard body and traversing along an inner side of the shoulder guard body between the first end and the second end of the shoulder guard body;

the band fastener being connected to the shoulder guard body and positioned adjacent to an outer side of the shoulder guard body, wherein the inner side and the outer side are positioned opposite each other on the shoulder guard body;

the shoulder guard being attached to the elastic body through the band fastener;

the band fastener comprising a first fastener end and a second fastener end;

the shoulder guard body extending laterally between a first lateral side and a second lateral side;

the first fastener end being hingedly connected to the first lateral side of the shoulder guard body;

the second fastener end being removably attached to the second lateral side of the shoulder guard body; and the elastic body being removably positioned between the band fastener and the shoulder guard body between the first lateral side and the second lateral side.

2. The muscular training tension band for equestrian riding as claimed in claim 1 comprising: the elastic body being a continuous closed loop.

3. The muscular training tension band for equestrian riding as claimed in claim 1 comprising: the elastic body being a flat, elastically deformable band.

4. The muscular training tension band for equestrian riding as claimed in claim 1 comprising: the shoulder guard being removably attached to the elastic body through the band fastener.

5. The muscular training tension band for equestrian riding as claimed in claim 1 comprising:

the band fastener being a first hook and loop tape portion;

a second hook and loop tape portion being connected to the elastic body; and the first hook and loop tape portion and the second hook and loop tape portion being removably attached to each other, wherein the elastic band is removably attached to the shoulder guard through the first hook and loop tape portion and the second hook and loop tape portion.

6. The muscular training tension band for equestrian riding as claimed in claim 1 comprising:

the shoulder guard further comprising a band channel, a first retaining lip, and a second retaining lip;

the first retaining lip traversing along a first lateral side of the shoulder guard body;

the second retaining lip traversing along a second lateral side of the shoulder guard body;

the band channel traversing along the outer side of the shoulder guard body between the first end and the second end; and the band channel being delineated by the first retaining lip and the second retaining lip, wherein the elastic body is retained within the band channel adjacent to the outer side of the shoulder guard body by the first lateral side and the second lateral side.

7. The muscular training tension band for equestrian riding as claimed in claim 1, wherein the elastic body is configured to be tensioned between a human shoulder and a human foot.

8. The muscular training tension band for equestrian riding as claimed in claim 1 comprising:

the shoulder guard being attached to the elastic body at a shoulder mounting point, wherein a foot mounting point is positioned opposite the shoulder mounting point along the elastic body, wherein the shoulder guard is configured to conform to a human shoulder, and wherein the foot mounting point is configured to receive a human foot.

9. A muscular training tension band for equestrian riding comprising:

an elastic body;

a shoulder guard;

the shoulder guard comprising a shoulder guard body, a padding, and a band fastener, wherein the shoulder guard body extends between a first end and a second end;

the padding being connected adjacent to the shoulder guard body and traversing along an inner side of the shoulder guard body between the first end and the second end of the shoulder guard body;

the band fastener being connected to the shoulder guard body and positioned adjacent to an outer side of the shoulder guard body, wherein the inner side and the outer side are positioned opposite each other on the shoulder guard body;

the shoulder guard being attached to the elastic body through the band fastener;

the band fastener comprising a first fastener end and a second fastener end;

the shoulder guard body extending laterally between a first lateral side and a second lateral side;

the first fastener end being hingedly connected to the first lateral side of the shoulder guard body;

the second fastener end being removably attached to the second lateral side of the shoulder guard body;

the elastic body being removably positioned between the band fastener and the shoulder guard body between the first lateral side and the second lateral side; and wherein the band fastener comprises a hinge clasp.

10. The muscular training tension band for equestrian riding according to claim 9, wherein the elastic body further comprises a continuous closed loop.

11. The muscular training tension band for equestrian riding according to claim 9, wherein the elastic body further comprises a flat, elastically deformable band.

12. The muscular training tension band for equestrian riding according to claim 9, wherein the shoulder guard is further configured to be removably attached to the elastic body through the band fastener.

13. The muscular training tension band for equestrian riding according to claim 9, further comprising:

the band fastener being a first hook and loop tape portion;

a second hook and loop tape portion being connected to the elastic body;

the first hook and loop tape portion and the second hook and loop tape portion configured to be removably attached to each other; and wherein the elastic band is configured to be removably attached to the shoulder guard through the first hook and loop tape portion and the second hook and loop tape portion.

14. The muscular training tension band for equestrian riding according to claim 9, further comprising:

the shoulder guard further comprising a band channel, a first retaining lip, and a second retaining lip;

the first retaining lip traversing along a first lateral side of the shoulder guard body;

the second retaining lip traversing along a second lateral side of the shoulder guard body;

the band channel traversing along the outer side of the shoulder guard body between the first end and the second end;

the band channel being delineated by the first retaining lip and the second retaining lip; and wherein the elastic body is retained within the band channel adjacent to the outer side of the shoulder guard body by the first lateral side and the second lateral side.

15. The muscular training tension band for equestrian riding according to claim 9, wherein the elastic body is configured to be tensioned between a human shoulder and a human foot.

16. The muscular training tension band for equestrian riding according to claim 9, further comprising:

the shoulder guard being attached to the elastic body at a shoulder mounting point;

wherein a foot mounting point is positioned opposite the shoulder mounting point along the elastic body;

wherein the shoulder guard is configured to conform to a human shoulder; and wherein the foot mounting point is configured to receive a human foot.

* * * * *